US005699320A

United States Patent [19]

Wan

[11] Patent Number: 5,699,320

[45] Date of Patent: Dec. 16, 1997

[54] SOCKET SET WITH A TIMER

[75] Inventor: David Wan, Hsin-Tein, Taiwan

[73] Assignee: Frontier Technology Co., Ltd., Hsin-Tien, Taiwan

[21] Appl. No.: 762,857

[22] Filed: Dec. 10, 1996

[51] Int. Cl.[6] ..... G04B 47/00; H01H 7/08

[52] U.S. Cl. ..... 368/10; 368/141

[58] Field of Search ..... 368/10, 107–109; 200/38 R, 38 DA; 397/141, 14.4

[56] References Cited

U.S. PATENT DOCUMENTS 4,097,763 6/1978 Saarem ..... 307/141

4,280,063 7/1981 Yokomori et al. ..... 307/141.4

4,354,120 10/1982 Schornack ..... 307/132 C 4,853,558 8/1989 Sharivoda ..... 307/141

5,258,656 11/1993 Pawick ..... 307/141

*Primary Examiner*—Vit W. Miska

*Attorney, Agent, or Firm*—Bacon & Thomas

[57] ABSTRACT

An improved socket set with a timer has an upper cover and a lower shelter that are combined to form a case in which a timer, a circuit board, an IC board and two socket seats are housed. The timer can be easily removed and selectively oriented in one of four orthognal directions. The socket seats can also be removed and limitedly refined by turning 90 degrees around so as to facilitate the installation of the socket set in different situations.

2 Claims, 7 Drawing Sheets

SOCKET SET WITH A TIMER

BACKGROUND OF THE INVENTION

The present invention relates to a wall-mounted socket set equipped with a timer including an upper cover, a lower shelter, a circuit board and an IC board. The upper cover accommodates a timer and the lower shelter houses the circuit board. The upper cover and the lower shelter are secured to each other in assembly. The orientation of the timer can be set in one of four orthgonal directions and the socket seats can be placed in two directions 90 degrees turning around so as to facilitate the practical use of the present invention.

Timers have been popularly applied to household electrical appliances in modern societies because the timers can help people take care of the operations of their household electrical appliances in an effective manner once an operation time is preset. In general, the conventional timers are separately purchased and plugged into engagement with wall mounted sockets and then the plugs of household electrical appliances are connected to the additional sockets disposed on the timers, as shown in FIG. 1. It is not economical to purchase separate timers in one aspect and the use of such conventional plus-in type timers is not easy to fix sometimes because they can drop off from their sockets as a result of an accidental bumping on a projected timer by people walking nearby in another aspect.

SUMMARY OF THE INVENTION

The primary object of the present invention is to provide an improved wall-mounted socket set with a timer which is integrally made to include both sockets and a timer having an artistic outer appearance.

Another object of the present invention is to provide an improved socket set with a timer which can be changed with its orientation of its socket seats and timer in consideration of installational facility.

BRIEF DESCRIPTION OF THE INVENTION

DETAILED DESCRIPTION OF THE PREFERRED EMBODIMENTS

Figure 1:
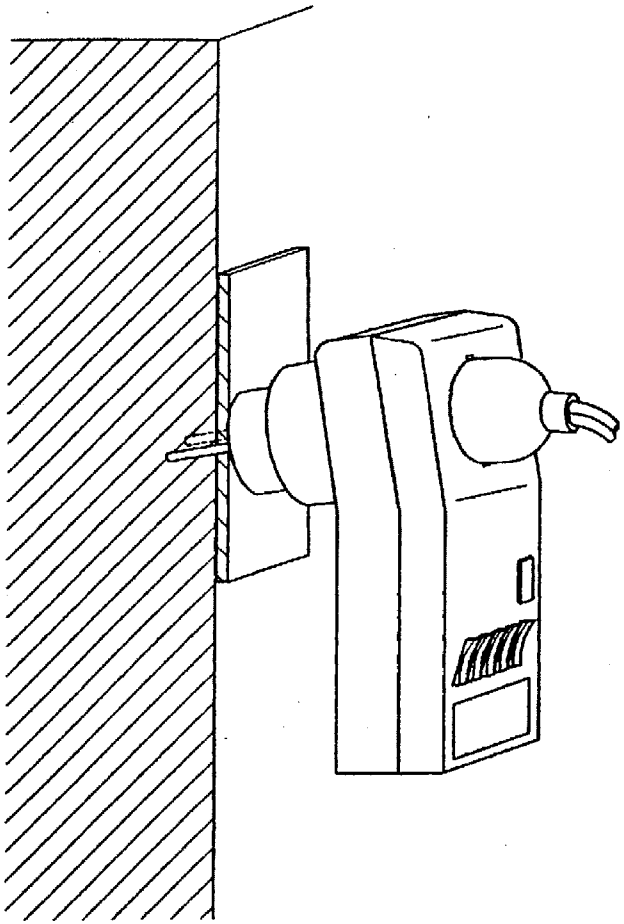
FIG. 1 PRIOR ART
FIG. 1 is a diagram showing a conventional timer mounted onto a socket set.
Figure 2:
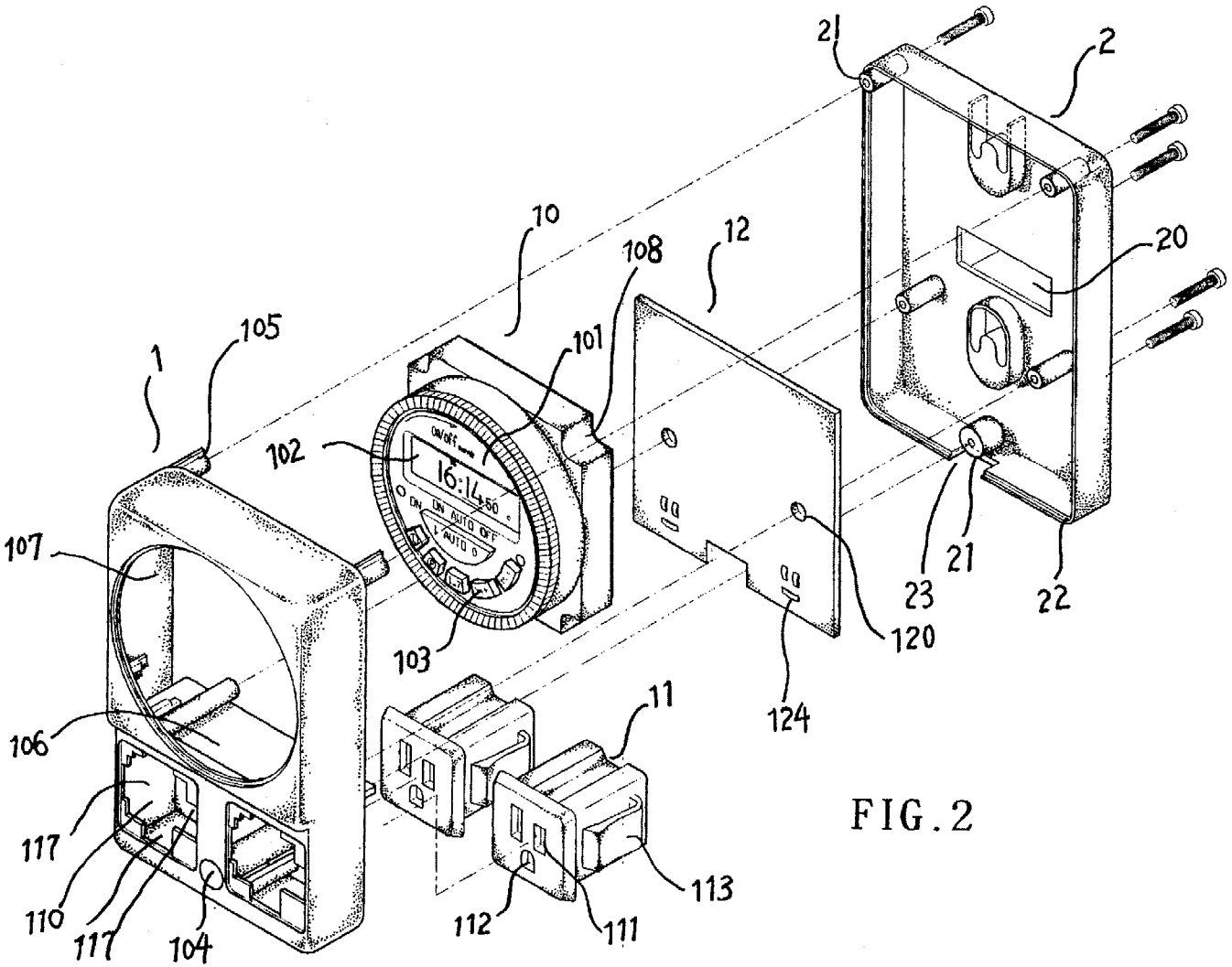
FIG. 2 is a perspective diagram showing the exploded components of the present invention.
Figure 3:
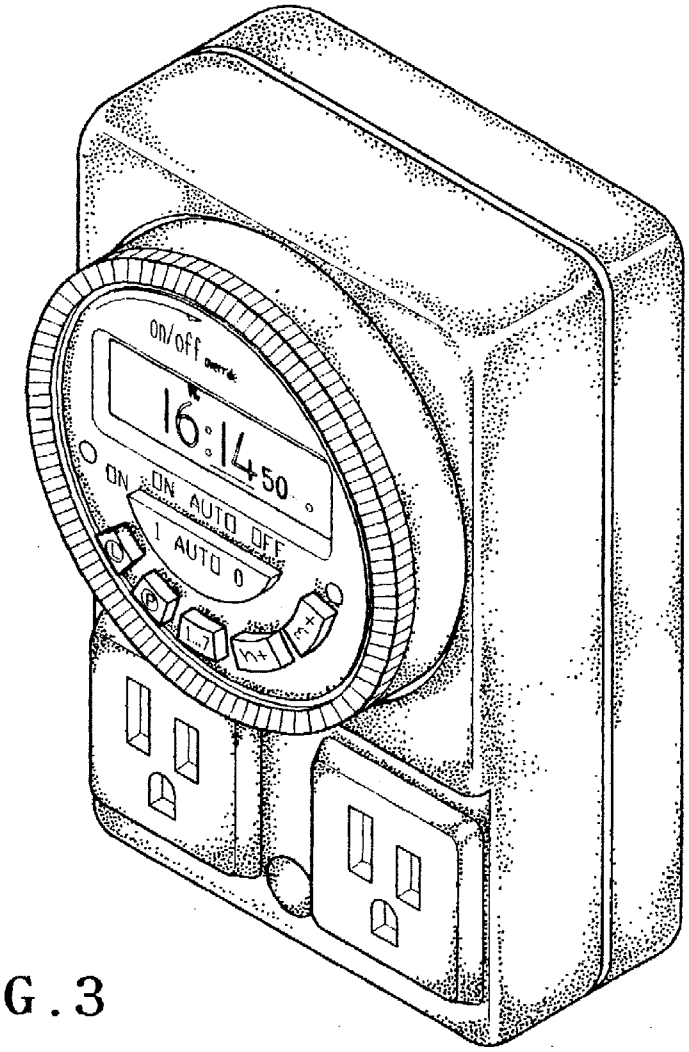
FIG. 3 is a diagram showing the assembly thereof.
Figure 4:
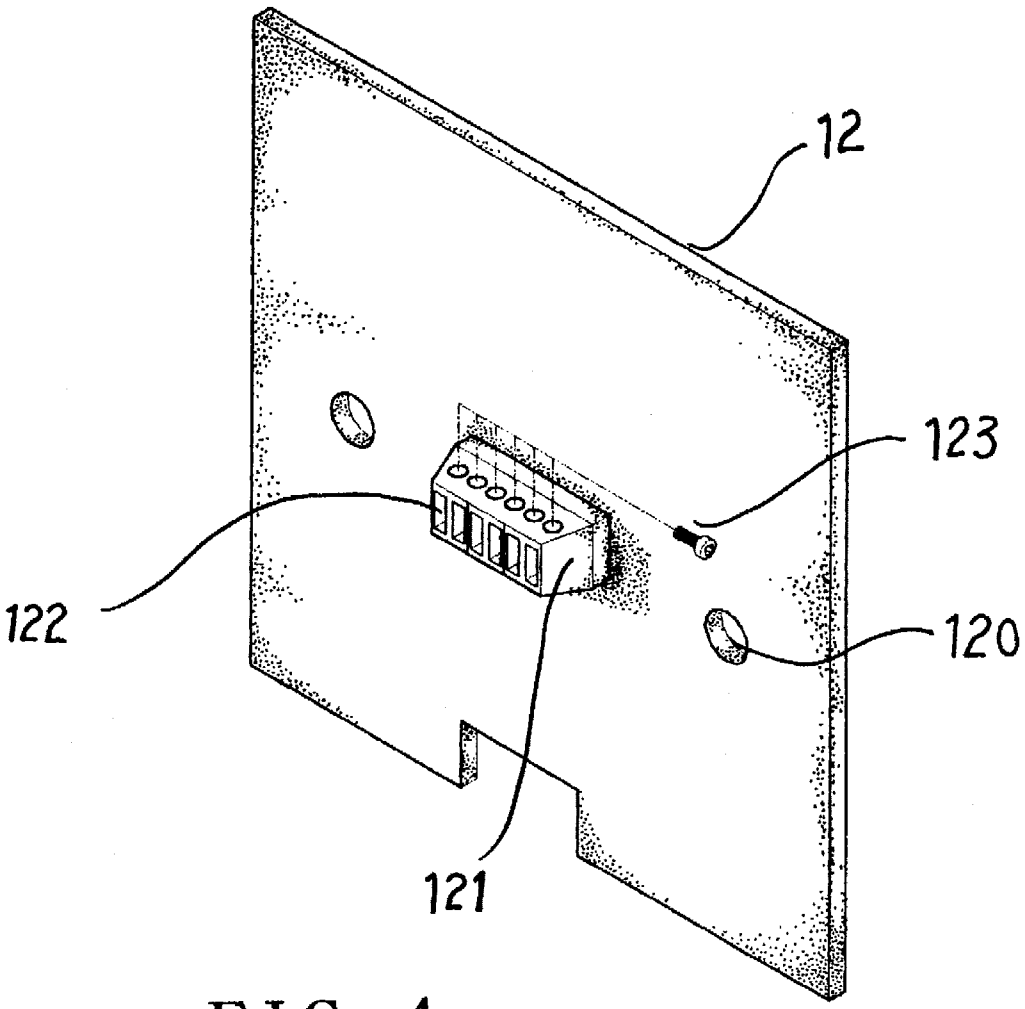
FIG. 4 is a perspective diagram showing the IC board of the present invention.

Referring to FIGS. 2,3,4, the wall-mounted socket set with a timer of the present invention is provided with an upper cover 1, a lower shelter 2, a circuit board 3 and an IC board 12. The upper cover 1 is of a. rectangular shape and is smoothly rounded at four corners thereof and is provided with a round opening 107 at the upper portion thereof for receiving a timer 19. At the lower portion of the upper cover 1, are there two square holes 119 each for housing a socket seat 11. The top side, the left side, the bottom side and the right side of each square hole 110 are provided with a wide slide groove 117.

Each socket seat 11 has a resilient retaining member 113 disposed on the right and left sides thereof which can be pushed into engagement with the slide groove 117 of each square hole 110. Each socket seat 11 having a pair of parallel linear plugging slots 111 and a semicircular hole 112 disposed just under the slots 111 is limited to be selectively rotated 90 degrees to vary the orientation of each socket seat 11. The socket seats 11 are easily removed from the square holes 110 by simply actuation on the retaining members 113. There are 3 conducting pieces ( not shown ) at the end of each socket seat 11, in correspondence to 3 projected conducting points 124 of the IC board 12.

A screw hole 104 is disposed between the two square holes 110. A circuit board 3 ( not shown ) is housed in the upper Portion of the upper cover 1 and there are four positioning posts 185 disposed between a partition board 106 and the top of the upper cover 1 so as to permit the upper cover 1 and the lower shelter 28 to be screwed together.

The IC board 12 has two symmetric holes 120 disposed thereon for positioning purpose. The two holes 120 are engaged with the positioning posts 185 located right above the partition board 106.

At the center of the lower shelter 2 is provided with a rectangular slot 20 for receiving a wire mounting seat 121 disposed on the IC board 12 and having 6 insertion holes 122, as shown in FIG. 4. There are 6 fixing screws 123 used to retain inserted electric wires in place in the insertion holes 122. The conducting points 124 coupled to a power source are in abutment with the conducting pieces disposed on each socket seat 11.

The lower shelter 2 has a peripherally disposed retaining groove 22 in conformance to a peripheral flange (not shown) on the upper cover for snap assembly of the upper cover 1 and the lower shelter 2.

The timer 18 removably disposed inside the opening 107 of the upper cover 1 has four roundly recessed corners 108 for positioning purpose. The timer 18 has a central face board 181 equipped with a rotatable peripheral ring member 100 having radial grip ditches, serving as a on/off switch. An LCD window 102 is disposed at the upper portion of the face board 101 and a set of buttons 103 are disposed at the lower portion of the face board 101.

Figure 5:
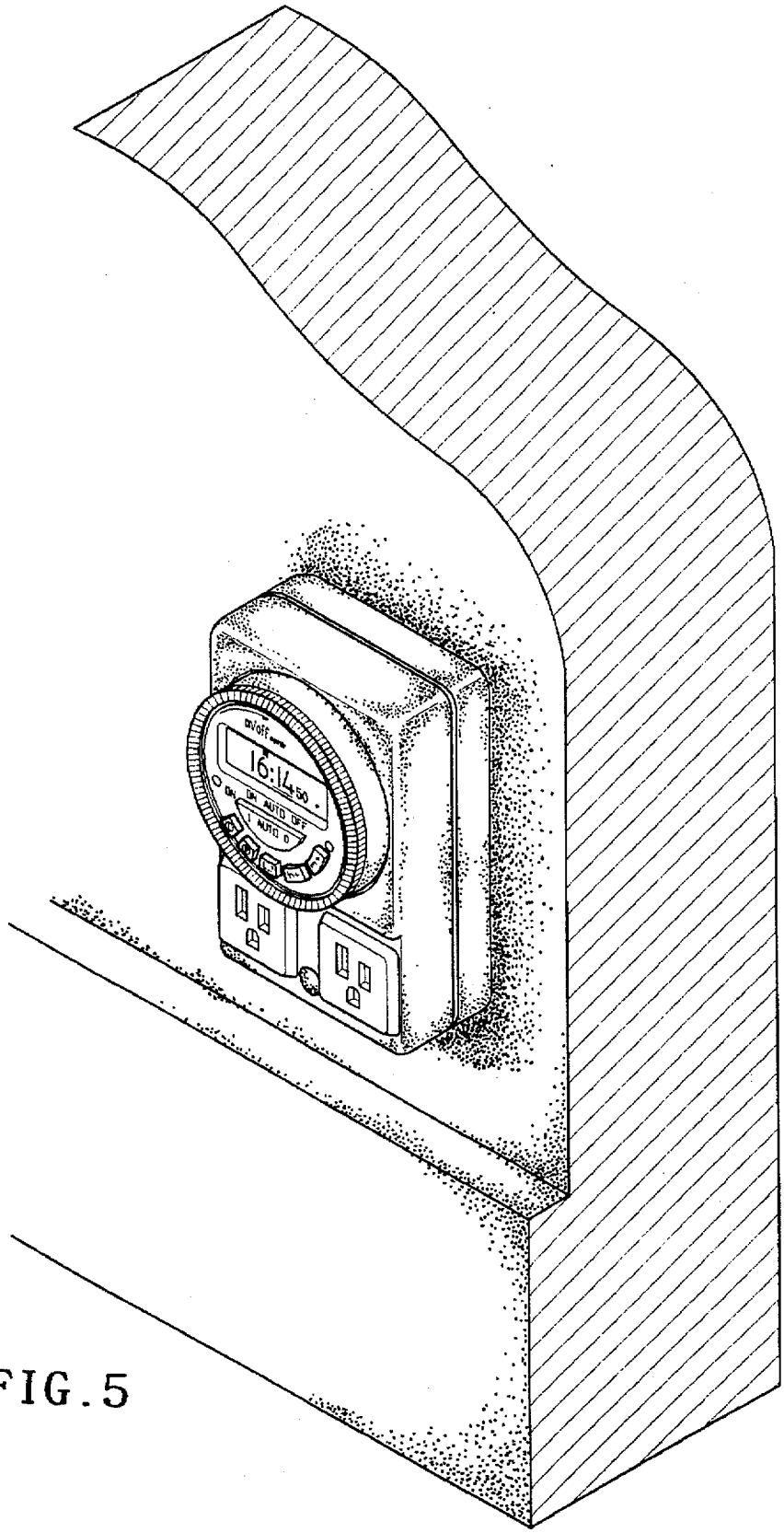
FIG. 5 is a first embodiment of the present invention.
Figure 6:
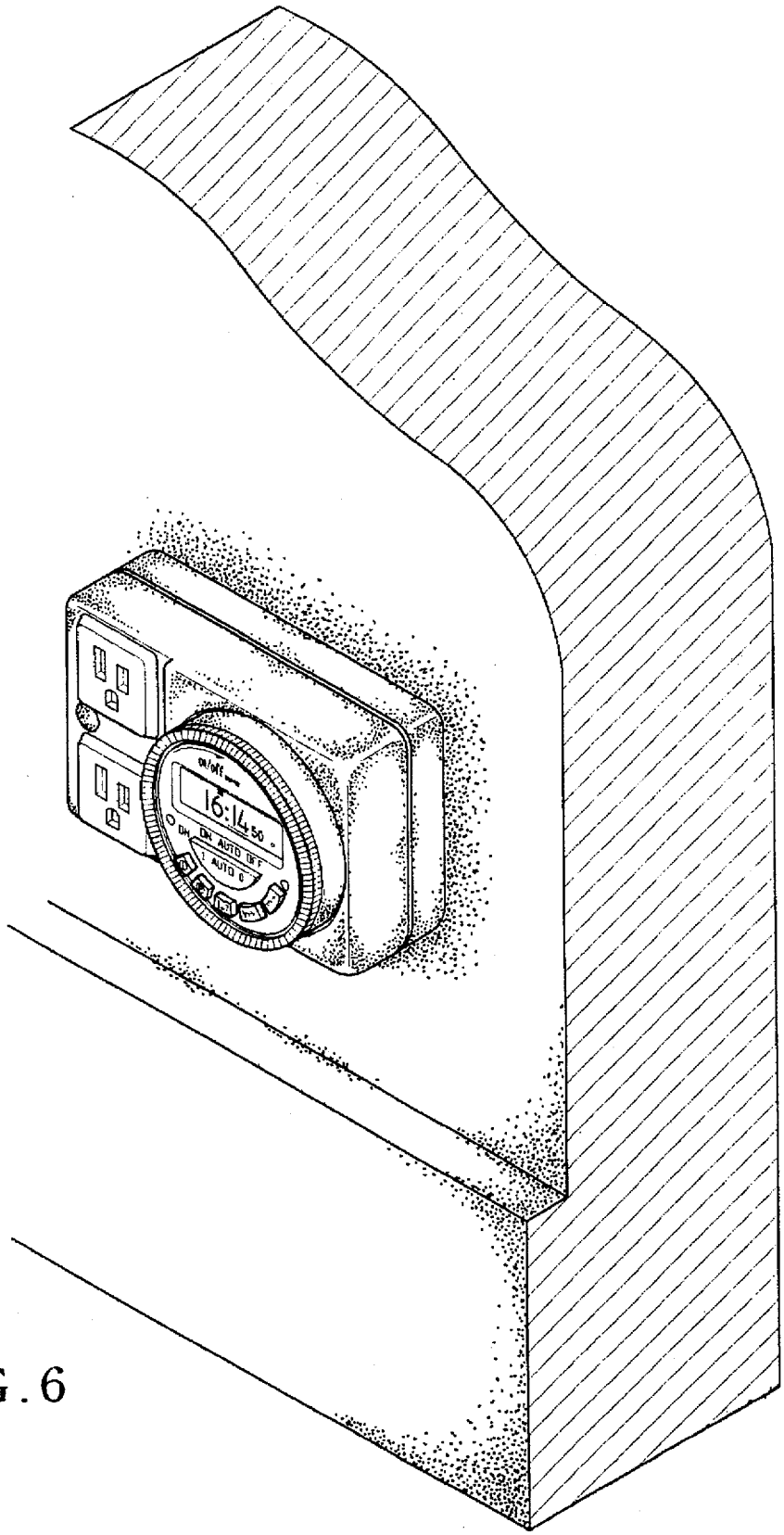
FIG. 6 is a second embodiment thereof.

In cope with the turning of 90 degrees around of the socket seats 11, as shown in FIGS. 5, 6, the IC board 12 is made in two optional types, so as to make the electrical conduction between the IC board and the socket seats effective in different situation.

Figure 7:
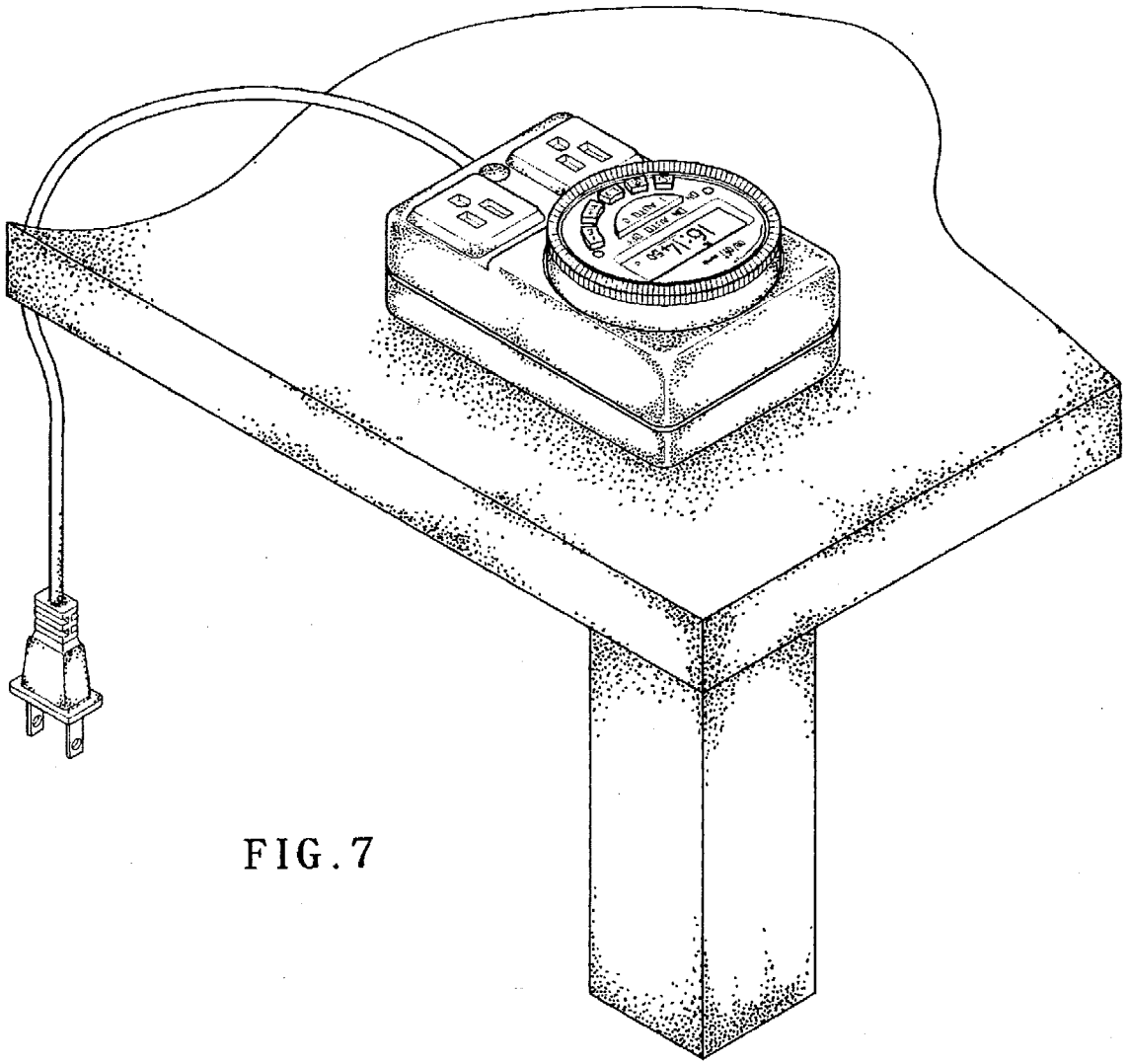
FIG. 7 is a third embodiment thereof.

As further shown in FIG. 7, the socket set of the present invention can be fixed on a table or place of the like instead of being mounted on a wall and is connected to an extension cord which can be led through a recess 23 disposed at the bottom of a lower shelter 2 so as to permit the socket set to be placed at any desired location.

There are a number advantages associated with the present improved socket set with a timer, given as below:

1. The socket set of the present invention can replace conventional wall-mounted socket sets so as to save household budget in purchase additional timers.
2. The orientation of the timer can be varied with ease, as shown in FIGS. 5, 6 in addition to 90-degree turning around of the socket seats in use so as to facilitate the positioning of the socket set in a building.
3. An extension cord can be applied to the socket set, as shown in FIG. 7, facilitating the location of the socket set of the present invention without limit.
4. Artistic design of the present invention makes the same appealing to the eyes when mounted onto a wall.

I claim:

1. An improved wall-mounted socket set with a timer, comprising:

an upper cover of a rectangular shape having a round opening at the upper portion thereof and a pair of square holes at the lower portion thereof;

a pair of socket seats each being removably received in said square holes of said upper cover; each said socket seat having a resilient retaining member on the right and left sides thereof and having two linear plug holes and a semi-circular hole for plugging purpose;

a lower shelter of a rectangular shape having four locking posts in which screws are housed so as to secure said upper cover to the lower shelter in assembly; having a rectangular slot for receiving a wire mounting seat disposed on said IC board; having a number of locking posts in conformance to the positioning posts on said upper cover for assembly purpose by way of screws; having a locking post in alignment with the screw hole of said upper cover; having a retaining groove on the periphery thereof in conformance to a peripheral flange of said upper cover for retaining purpose in assembly; having a recess at the bottom thereof for passage of electric wires;

a timer removably disposed inside said opening of said upper cover having four roundly recessed corners for positioning purpose; and having a central face board equipped with a rotatable peripheral ring member having radial grip ditches, serving as an on/off switch;

an LCD window disposed at the upper portion of said face board and a set of buttons disposed at the lower portion of said face board.

2. The improved socket with a timer as claimed in claim 1 wherein said timer can be removed from said opening of said upper cover and be selectively placed in one of four directions anew and said socket seats can be removed from the square holes and be limitedly rotated 90 degrees around and fixed in another orientation.

* * * * *